US005180471A

United States Patent [19]

Sauer et al.

[11] Patent Number: 5,180,471

[45] Date of Patent: Jan. 19, 1993

[54] NON-NESTING MULTI-PLY TISSUE AND METHOD FOR MAKING SAME

[75] Inventors: Robert D. Sauer, Freedom; Mustafa M. Jamal, Menasha, both of Wis.

[73] Assignee: Kimberly-Clark Corporation, Neenah, Wis.

[21] Appl. No.: 638,935

[22] Filed: Jan. 9, 1991

[51] Int. Cl.[5] ..... D21H 27/40

[52] U.S. Cl. ..... 162/112; 162/113; 162/131; 162/204

[58] Field of Search ..... 162/109, 111, 112, 113, 162/120, 204, 131

[56] References Cited

U.S. PATENT DOCUMENTS 3,044,228 7/1962 Peterson ..... 162/113
3,592,732 7/1971 Wand ..... 162/204
3,879,257 4/1975 Gentile ..... 162/112
4,166,001 8/1979 Dunning et al. ..... 162/112
4,344,818 8/1982 Nuttall et al. ..... 162/111

FOREIGN PATENT DOCUMENTS 595821 2/1978 Switzerland ..... 162/113

*Primary Examiner*—Peter Chin
*Attorney, Agent, or Firm*—G. E. Croft

[57] ABSTRACT

The bulk and absorbency of multi-ply tissue products can be improved by brushing at least one surface of at least one ply of the tissue and plying the tissue product together such that at least one brushed surface is facing inwardly, i.e. is in the middle and not on the outside of the multi-ply product.

30 Claims, 5 Drawing Sheets

NON-NESTING MULTI-PLY TISSUE AND METHOD FOR MAKING SAME

BACKGROUND OF THE INVENTION

In the manufacture of creped tissue products, there is always a continuing effort to improve the properties of the final product. Such properties particularly include the attributes of softness and bulk. For example, U.S. Pat. No. 1,508,087 to Davies and U.S. Pat. No. 3,592,732 to Wand disclose improving the surface softness of a tissue or the like by brushing the outer surface of a paper web. U.S. Pat. No. 4,300,981 to Carstens produces a similar product, but attempts to characterize the surface softness of a tissue in terms of indexes reflecting the flatness and fuzziness of the tissue surface. U.S. Pat. No. 4,100,017 to Flautt discloses increasing bulk softness by plying together two creped webs which have different crepe frequencies and amplitudes so that "nesting" of the two plies does not occur. U.S. Pat. No. 3,994,771 discloses improving bulk softness by forming a layered web and subjecting the web to fluid forces while supported by an open mesh drying fabric to create a pattern of pillows or so-called "discrete deflected areas". Although all of the aforementioned prior art is concerned with bulk softness or surface softness, the prior art has not been able to provide a method for achieving surface softness and bulk softness in the same product.

SUMMARY OF THE INVENTION

Applicants have unexpectedly discovered that the desireable combination of bulk softness and surface softness can be achieved by modifying one or more internal surfaces of multi-ply tissues to increase the extent to which the fibers of the internal surfaces protrude therefrom. Such a modification generates bulking features at the interface of the plies, which in turn provides greater bulk and bulk softness to the multi-ply tissue. At the same time, one or both of the outer surfaces of the multi-ply tissue can be made to have a high degree of surface softness in any number of ways known in the art.

Hence, in one aspect the invention resides in a method for making a multi-ply tissue in which an aqueous slurry of papermaking fibers is deposited onto a traveling foraminous fabric, dewatered, and dried to form a first tissue web, said first tissue web being combined with one or more other tissue webs to form a multi-ply tissue, the improvement comprising brushing at least one surface of the first tissue web to increase the extent to which fibers protrude from the brushed surface of the first tissue web and combining the first tissue web with the other one or more tissue webs to form a multi-ply tissue such that the brushed surface of the first tissue web is facing inwardly.

In another aspect, the invention resides in a method of making a two-ply tissue comprising: (a) continuously forming a web by depositing an aqueous slurry of papermaking fibers onto an endless foraminous fabric; (b) dewatering the web; (c) creping the dried web; (d) brushing the surface of the creped web with a rotating brush to increase the extent to which fibers protrude from the brushed surface; and (e) combining the brushed web with a like web to form a two-ply tissue, wherein the brushed surfaces of each web are in contact with each other.

In another aspect, the invention resides in a multi-ply tissue having two outer surfaces and two or more internal ply surfaces, wherein at least one of said internal ply surfaces has a Profile Index of at least about 3, and preferably about 5 or greater. The Profile Index is a measure of the extent to which fibers protrude from the surface of a web and is described hereinafter in greater detail. The multi-ply tissue is preferably a two-ply tissue or a three-ply tissue.

Tissue webs suitable for purposes of this invention include any webs suitable for making products such as facial tissue, bath tissue, kitchen towels, and the like. The individual webs can be layered or homogeneous. Dry basis weights for such webs preferably are from about 5 to about 40 pounds per 2880 square feet. Suitable fibers include natural or synthetic fibers, preferably fibers normally used for papermaking. If the webs are formed by a layering process, it is preferred that the layer comprising the surface to be brushed contain a large percentage, such as about 30 weight percent or greater, of relatively long fibers which can protrude from the surface and hence increase the Profile Index of the surface of the web when brushed. If the web is a homogeneous (nonlayered) web, it is preferred that the furnish contain about 30 weight percent or greater relatively long fibers for the same reason. "Relatively long fibers" are those fibers having an average length of about 1.5 millimeters or greater. Preferred examples of relatively long fibers are softwood papermaking fibers. The tissue webs suitable for purposes of this invention can be made by a variety of methods suitable for making tissue products or related products, including conventional wet press or throughdrying papermaking processes. The tissue webs can be creped or uncreped.

Brushing a surface of the tissue web can be carried out by any means which causes fibers on the brushed surface of the web to be deflected out of the plane of the surface of the web. Brushing can preferably be accomplished by moving the surface of the web relative to a brushing surface, which can be a stationary surface or a moving surface. If brushing is performed using a moving brushing surface, the moving brushing surface can be moving in the direction of travel of the web, counter to the direction of travel of the web, crosswise to the direction of travel of the web, or any direction in between or any combination thereof.

The brushing surface itself can be any textured surface which does not degrade the web to the extent that the web is no longer useful for its intended purpose. A suitable brushing surface is a rotating brush of the type disclosed in U.S. Pat. No. 3,592,732 to Wand. One such suitable brushing surface comprises a plurality of nylon bristles having a length of about ½ inch, a denier of about 15, and a density of about 2500 bristles per square inch. However, many other types of brushing surfaces can also be used, provided they increase the extent to which fibers extend from the surface of a tissue web without degrading the web to the point that it is not useful for its intended purpose.

The velocity of the rotating brushing surface relative to the velocity of the web at the point of contact has a significant impact on the resulting Profile Index of the brushed surface. Greater velocity differentials correspond to higher Profile Index values up to a point. Rotating the brush counter to the direction of travel of the web or across the direction of travel of the web provides the greatest opportunities to increase the Profile Index because of the orientation of the fibers within the tissue web, which can be influenced by the jet/wire speed ratio during initial formation of the web.

DETAILED DESCRIPTION OF THE DRAWING

Figure 1A:
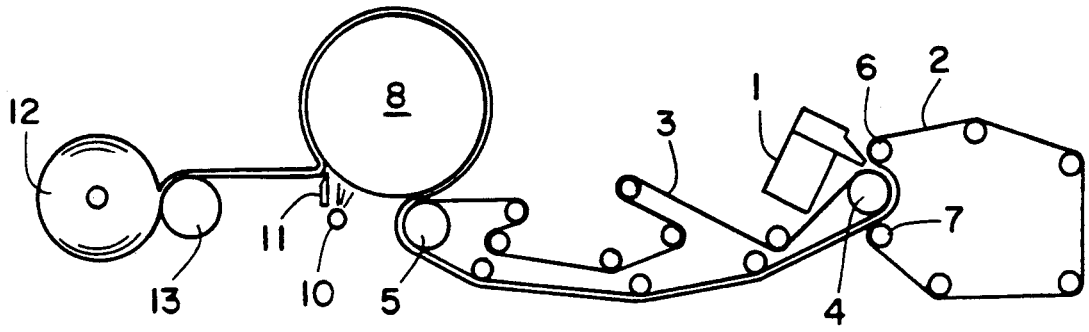
FIG. 1A is a schematic flow diagram of a wet press method of making a tissue suitable for brushing in accordance with this invention.

Referring to the Drawing, the invention will be described in greater detail. Like reference numerals in different Figures refer to like features.

FIG. 1A is a schematic flow diagram of a wet press method of making tissue webs suitable for use in connection with this invention. Depicted is a conventional wet press tissue making process in which a headbox 1 deposits an aqueous slurry of papermaking fibers between a moving forming wire 2 and a dewatering felt 3. The felt is wrapped around the forming roll 4 and a pressure roll 5 and nine tensioning rolls (shown but not numbered) to form a continuous loop. The forming wire is wrapped around the breast roll 6 and the take-off roll 7 and four additional rolls (shown but not numbered) used to adjust the tension on the forming wire and complete the continuous loop. With the various rolls positioned as shown, the forming wire also partially wraps around the forming roll to create a forming and dewatering zone. Some water is removed from the fibrous slurry in the forming zone, where the newly formed web preferentially adheres to the felt and is carried thereon to the Yankee dryer 8. Additional water is removed from the web with the aid of vacuum boxes or pressure nips prior to reaching the Yankee dryer. Transfer of the dewatered web to the Yankee dryer is accomplished at the pressure roll, which presses the web against the surface of the Yankee. Adhesion of the web to the Yankee surface is preferably augmented with the presence of a creping adhesive, which can be applied with a suitable spray device 10. The web is then dried to about 5% moisture and is dislodged from the Yankee dryer by contact with a doctor blade 11 (known as creping). The resulting creped web is then wound into a soft roll or parent roll 12 with the aid of a reel drum 13.

As previously mentioned, such a tissue making process is conventional and other processes can also be used to make webs for use in connection with this invention. For example, a layered headbox can be used to form a layered web having multiple layers of fibers in order to achieve certain surface characteristics, economy, strength, or a combination of different properties which a layered configuration affords. Throughdrying, either in addition to or as a substitute for the Yankee dryer, can also be used in combination with layering or without layering.

Figure 1B:
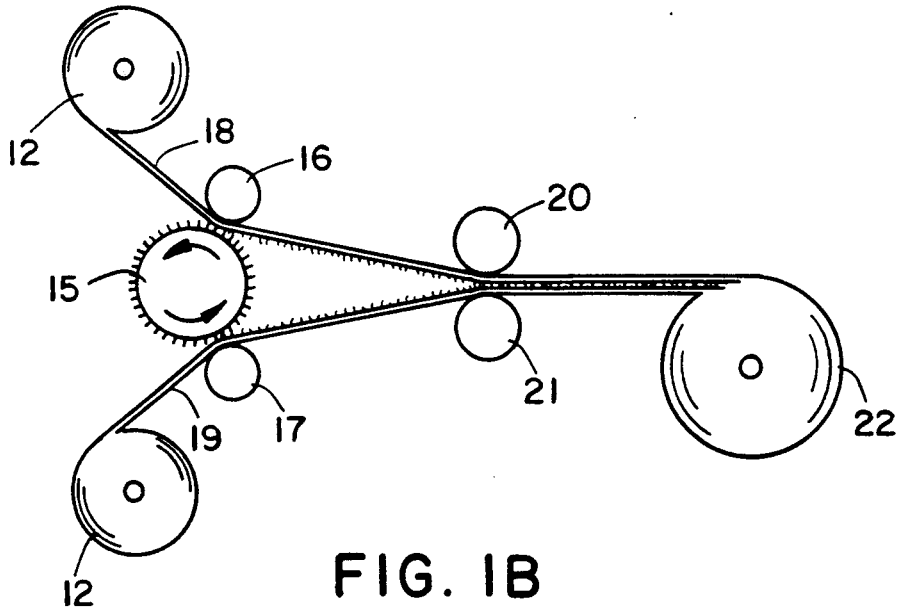
FIG. 1B is a schematic flow diagram of a preferred method of brushing a tissue web in accordance with this invention.

After two parent rolls 12 of like tissue are produced, these parent rolls can be unwound and simultaneously brushed as shown in FIG. 1B. It is not necessary that they be brushed simultaneously as shown, however, and it is suitable to brush each web independently if desired. More specifically with respect to FIG. 1B, one of the two like rolls is preferably inverted relative to the other so that the same side of both webs is brushed. Whether or not the dryer side of the web (the side of the web in contact with the dryer during drying) or the air side of the web (the side of the web not in contact with the dryer during drying) is brushed can depend upon the furnish of the web, the presence or absence of a layered structure, the strength of the web, and the desired properties of the final product. There can be an advantage in brushing the air side of a creped web, however, in that the air side of the web is typically more rough than the dryer side of the web due to the effects of creping. The crepe folds on the air side of the web have a greater amplitude than on the dryer side and hence also have a greater propensity to nest with like webs. Accordingly, it is advantageous to design the product to have the smoother side (dryer side) of the outer ply facing outwardly to impart maximum surface softness to the product, while the rougher side (air side) of the outer ply is brushed and facing inwardly for maximum bulk or bulk softness. As shown in FIG. 1B, both tissue webs are brushed using a single brushing roll 15 and two backing rolls 16 and 17. In this embodiment, the top web 18 is brushed in a direction counter to the direction of travel of the web, while the bottom web 19 is brushed in the direction of travel of the web. This creates a different effect on each of the web surfaces and is believed to create greater bulk than if the two webs were both brushed in the same direction. After brushing, the two webs are brought together to form a multi-ply tissue in which the two brushed surfaces are in contact with each other. Combining the two webs to form a two-ply product can be accomplished in any conventional manner, such as by crimping, embossing and the like. As shown, the two webs are brought together in a nip between two compaction rolls 20 and 21 and thereafter wound onto a hardroll 22 as a roll of two-ply tissue for subsequent conversion (cutting, folding, packaging, etc.) into the final product form (facial tissue, bath tissue, paper towels, etc.) in a conventional manner.

Figure 2A:
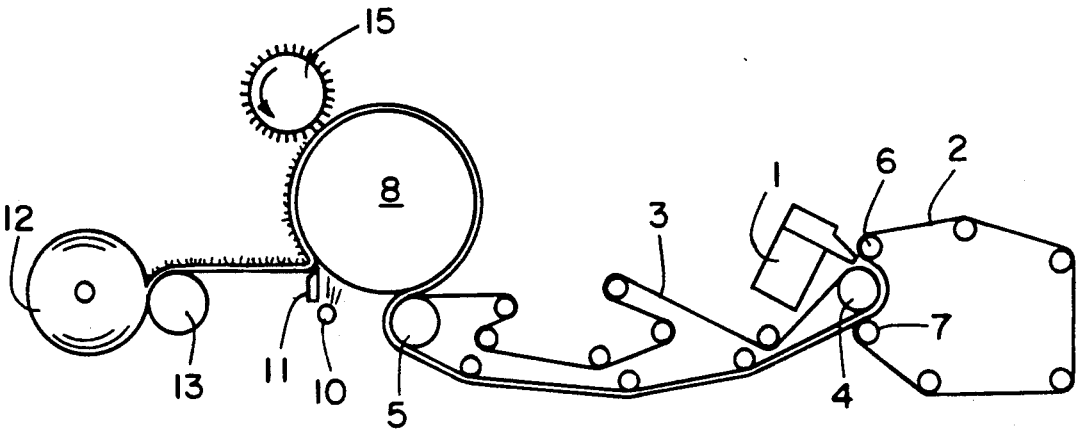
FIG. 2A is a schematic flow diagram of an alternative method of practicing this invention, in which the tissue web is brushed prior to creping.
Figure 2B:
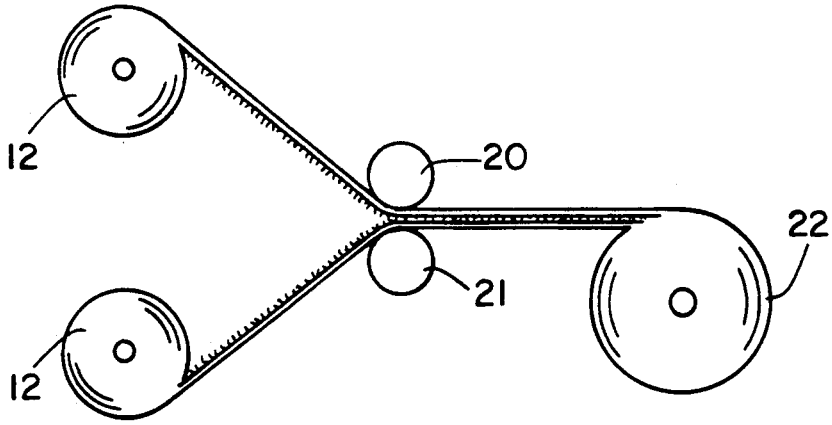
FIG. 2B is a schematic flow diagram of the process of plying together tissue webs produced in accordance with the method of FIG. 2A.

FIG. 2A illustrates an alternative embodiment of this invention, in which an uncreped tissue web is brushed on the air side of the web prior to creping. Aside from the presence of a brushing roll 15 positioned above the Yankee, the tissue making process illustrated is identical to that shown in FIG. 1A. In this embodiment, however, as illustrated in FIG. 2B, the two parent rolls 12 of like product are simply unwound and plied together between compaction rolls 20 and 21 in a conventional manner such that the brushed surfaces of the two webs are in contact with each other.

Figure 3:
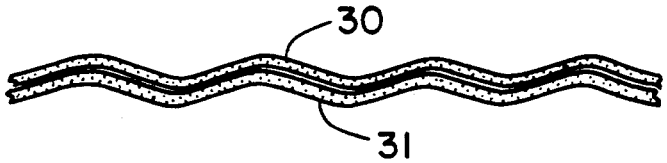
FIG. 3 is a cross-sectional representation of a conventional two-ply tissue product.

FIG. 3 is a schematic cross-sectional view of a conventional two-ply tissue consisting of a first ply 30 and a second ply 31, illustrating the manner in which the crepe folds of the individual webs or plies tend to nest together when the two webs are of like kind (same percentage of machine direction stretch), as is the case when made on the same machine under substantially the same conditions.

Figure 4:
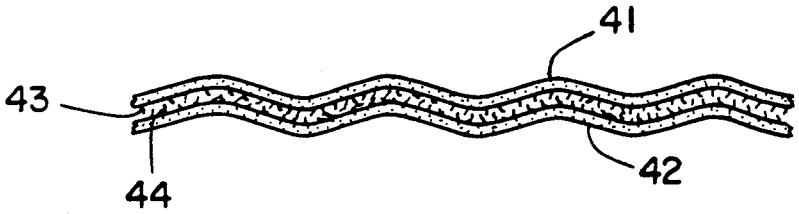
FIG. 4 is a cross-sectional illustration of a preferred two-ply tissue product of the invention in which the internal surfaces of both plies have been brushed.

FIG. 4 is a cross-sectional view of a product in accordance with this invention, wherein both the first ply 41 and the second ply 42 have been brushed and wherein their inwardly-facing brushed surfaces 43 and 44 are in contact with each other. As shown, the brushed surfaces result in an increase in the effective thickness of each of the brushed webs due to the presence of fibers extending outwardly from the brushed surface. As the two plies are brought together, the outwardly-extending fibers of each ply contact those of the other ply and impede the extent to which the two plies can be brought into closer contact. The beneficial effect on bulk is greater when both plies have been brushed, but some benefit can also be gained if only one ply is brushed. It is important to note that the increased bulk benefits are not necessarily attributable to the number of fiber ends extending from the plane of the web, but are more a function of the length of the extension. Fiber loops also contribute to the bulk increase.

Figure 5:
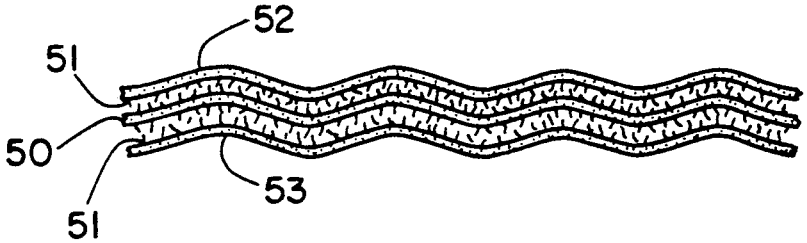
FIG. 5 is a cross-sectional illustration of a preferred three-ply tissue product of this invention.

FIG. 5 is a cross-sectional view of a three-ply product in accordance with this invention. In this embodiment, both sides of the center ply 50 have been brushed, while only the inwardly-facing surface 51 of each of the two outer plies 52 and 53 has been brushed. It will be appreciated that a number of combinations of contacting brushed sides are possible with a three-ply product. In all cases, however, there must be at least one inwardly-facing brushed surface.

FIGS. 6A, 6B, 6C, 6D, 7, 8 and 9 pertain to the determination of the Profile Index and are discussed below in connection with the description of the Profile Index method.

PROFILE INDEX

The Profile Index is a measure of the degree of surface irregularity present in the form of protruding fibers and fiber structures. As such it is indicative of the extent to which adjacent plies of tissue will be spaced apart when their fibrous surfaces are brought together. More specifically, the Profile Index is an index that quantifies the imaged silhouette of fibrous material protruding from the x-y plane of a tissue sample.

The Profile Index is measured using a digital image analyzer. The use of the Model Q-10 image analyzer, previously sold by Olympus Corporation, Lake Success, N.Y., in conjunction with Cambridge Instrument Corporation, Cambridge, England, is described herein, although other image analyzers can also be adapted to measure the Profile Index. The Q-10 digitizes a video image into a 512 (horizontal) by 480 (vertical) pixel display. The Q-10 has a 6 bit analog/digital converter which permits the brightness of each pixel to be resolved into 64 discrete shades of gray. Input to the Q-10 is a Dage Series 65 monochrome video camera utilizing an RS-170 output. This camera uses a vidicon sensing tube and is operated with automatic gain, pedestal and target voltage adjustments. The camera has a resolution of greater than 250 line pairs. The Q-10 is also equipped with an optional shading corrector.

The video camera is mounted on an Olympus BHS microscope with a stereo viewing port. The measurement is made with a 4× objective and a 3.3× intermediate lens such that the field size is approximately 2.6 millimeters wide and 2.4 millimeters high when the signal is digitized by the Q-10 into 512×480 pixels.

When measuring the Profile Index, samples are illuminated in a transmission mode with a semi-diffused light source obtained by placing a diffuser directly on the microscope illumination collimator lens. For ease of use, a clear glass stage is used to set prepared samples. The Olympus microscope uses an electronic stage controlled by a joystick. The auto-stage is not essential to the measurement, but it does allow more rapid specimen positioning and testing.

Figure 6A:
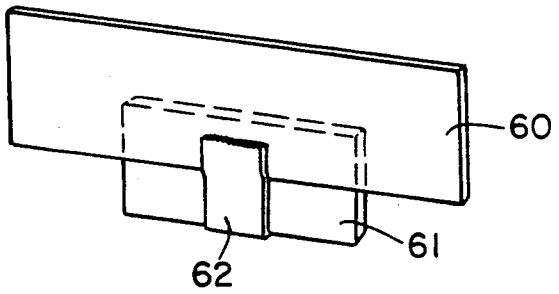
FIGS. 6A, 6B, 6C and 6D represent different views of certain steps in the preparation of samples for measuring the Profile Index.
Figure 6B:
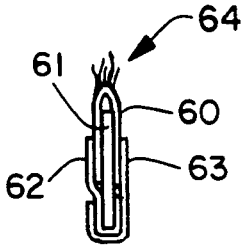
Figure 6C:
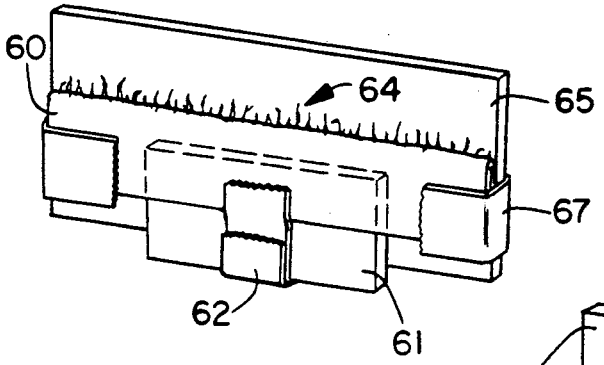
Figure 6D:
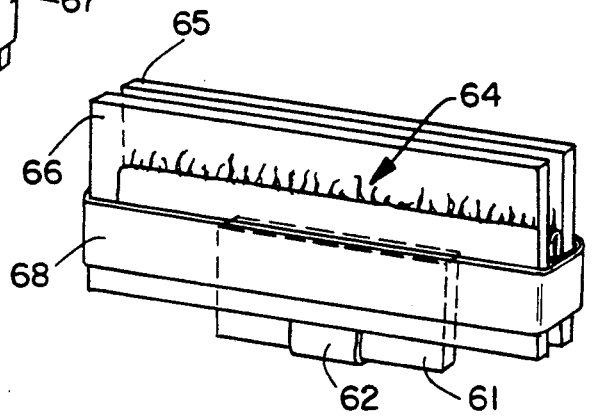
Figure 7:
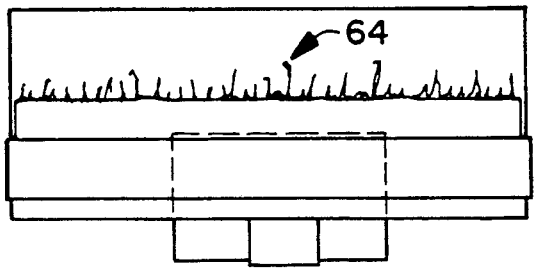
FIG. 7 is a side view representation of the prepared tissue sample illustrating the protruding fibers to be measured by the Profile Index.
Figure 8:
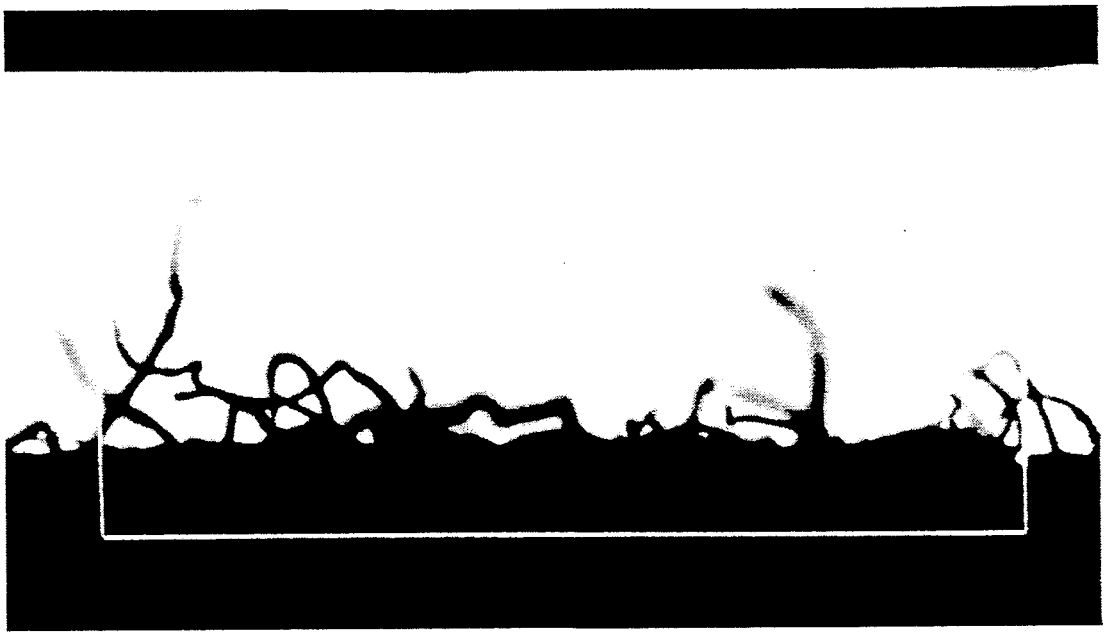
FIG. 8 is an actual photograph of the fibers protruding from a prepared tissue sample as it appears during measurement of the Profile Index.
Figure 9:
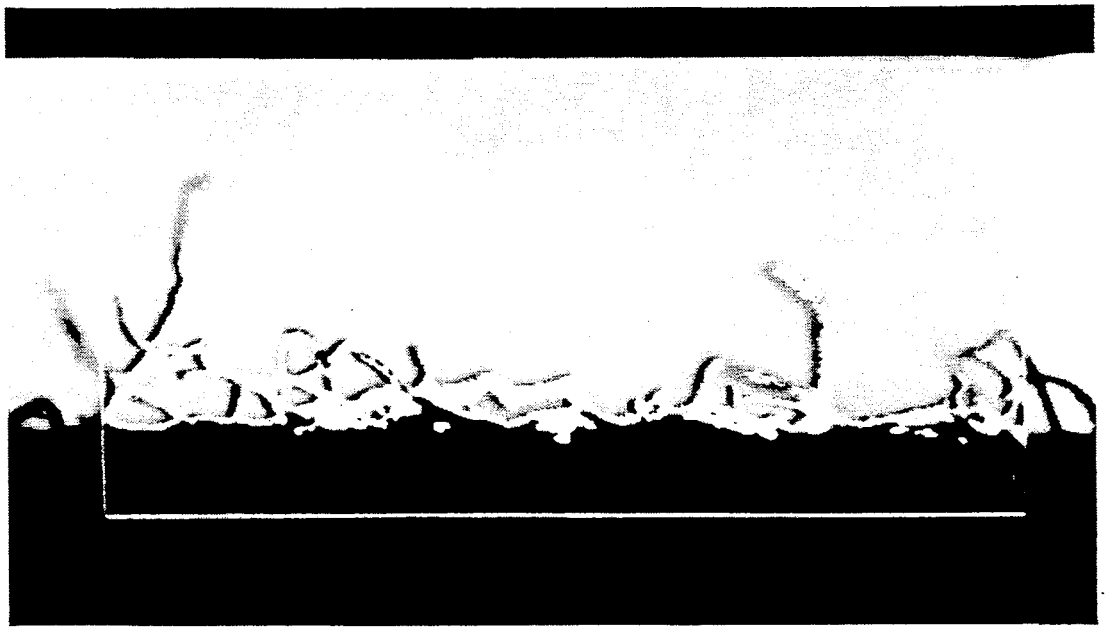
FIG. 9 is the same photograph as that of FIG. 8, except that the area detected by the Q-10 image analyzer for measuring the Profile Index is highlighted in white.

Referring to FIGS. 6A–6D, 7, 8 and 9, the sample preparation procedure will be described. In order to measure the Profile Index of a tissue, a sample 60 is cut to a dimension of one inch (machine direction) by three inches (cross-machine direction) and adhered to the side of a 0.1 mm thick, 22×40 mm glass coverslip 61 (No. 1, Corning Glass Works) using a strip of tape 62 as shown in FIG. 6A. The sample is then draped over the long edge of the glass slide such that the machine direction of the sample is perpendicular to the edge of the glass slide. The other end of the tissue sample is then adhered to the other side of the glass slide with a second strip of tape 63 as illustrated in cross-section in FIG. 6B. Bending the tissue over the slide exposes protruding fibers 64 (fiber size is greatly exaggerated for purposes of illustration) which are to be measured by the Profile Index. Two plain microslides 65 and 66 (1 mm thick, 25×75 mm) are then placed on both sides of the U-folded sample. The first microslide 65 is taped onto one side of the sample with tape 67 as shown in FIG. 6C. The second microslide 66 is taped to the sample and the first microslide with additional tape 68 as shown in FIG. 6D. This composite "sandwich" arrangement exposes protruding fibers along a linear edge of the tissue surface at the fold line of the sample. The composite is placed on a microscope stage in the path of transmitted light to view the exposed fold edge of the sample from the side. The prepared sample and resulting image appears generally as illustrated in FIG. 7. The image is then input to the Q-10 through the video camera. An actual photograph as viewed by the Q-10, magnified about 40×, is shown in FIG. 8. The area defined by the white box within the photograph is the measurement frame. FIG. 9 is the same as FIG. 8, except that the actual area detected by the Q-10 for measuring the Profile Index is highlighted in white.

In carrying out the Profile Index measurement, the specimen slide is placed on the microscopic stage such that the top of the field is clear and the bottom of the field is blocked by the sample on the slide. A measurement frame with dimensions of 1.2 mm in height and 2.6 mm in width are electronically placed around the image such that the tissue edge separating the slide from the clear field is very near to the bottom of this frame. The microscope is focused manually to give the sharpest contrast at the surface of the tissue edge. Individual fibers protruding from the edge are ignored during focusing to avoid biasing results. Next, the microscope illumination is adjusted so that the bright portions of the image (the clear part of the field) exhibit gray levels in the range of 52 to 56 (bright white has a gray level of 63). At this point, the solid dark regions of the image should be perfectly black (gray level zero). If this is not the case, the gain and offset of the analog-to-digital converter must be adjusted until both the dark and light grey levels are met. The test is then started over. (On the particular Q-10 image analyzer used for the Examples, the gain and offset were set to 15 and zero respectively. This equates to maximum gain and minimum offset. It must be noted that not all Q-10 image analyzers use the same analog-to-digital converter. These must be set to achieve the desired grey level range. Once the proper gain and offset are found, they will not need to be reset). Finally, the image is shade-corrected.

In order to calculate the Profile Index, several common image analysis functions are performed on the detected image. First, the image is thresholded or segmented. This step causes all pixels that have gray levels between approximately 2 and 45 to be identified. All other pixels are ignored. Following detection, all features (objects composed of contiguous identified pixels) less than three pixels in total width are eliminated. If done properly, these steps leave a single feature bounded by the outline of the specimen surface with all protruding fibers. The computer next measures the area of the feature(s) by counting the number of pixels identified. This area is composed of all pixels around the boundary of the specimen, up to the measurement and image frames. The area of all identified fibers/fibrils protruding away from the edge of the specimen in the plane of focus is included. When properly imaged and segmented, the image will appear as shown in FIG. 9.

The Profile Index is calculated as the difference between the identified area, as measured above, and the number of pixels a perfectly straight edge would form, divided by the number of pixels on said edge. An ideal imaging system would create a boundary of 512 pixels for such an edge. Experimentation has shown that the equipment used for this measurement doubles some pixels in a perfect boundary so that a sharp edge, on average, gives an area of about 650 pixels for a tissue web. To account for this, the Profile Index is calculated in accordance with the formula:

$$\textit{Profile Index} = (AREA - 650)/650.$$

wherein AREA is the pixel area identified by the Q-10. In order to accurately characterize a particular tissue sample, 52 different images are measured for individual Profile Index values and the 52 different Profile Index measurements are averaged.

EXAMPLES

To further illustrate the invention, a facial tissue grade basesheet was prepared substantially as shown in FIG. 1A. The furnish consisted of a homogeneous blend of 60 weight percent northern softwood kraft and 40 weight percent hardwood kraft. The basis weight of the finished single-ply basesheet was 8.05 pounds per 2880 square feet. Sample #1 was a two-ply creped tissue made from the abovesaid basesheet in which both plies, unbrushed, were plied together and calendered at 30 pounds per lineal inch. This sample is representative of conventional two-ply facial tissue as is available commercially. Sample #2 was a two-ply tissue representative of a product produced by the aforementioned Wand Patent, in which the air side of each ply was brushed by passing the web over a 7.5 inches diameter brush roll rotating in the direction of travel of the web with a surface speed 2.5 times faster than the speed of the web. The brush roll had 2500 nylon bristles per square inch, the bristles having a length of 0.5 inch, a denier of 15 and a diameter of 0.008 inch. Contact of the web with the brush roll was facilitated via a smooth idler roll mounted in a vertical position below the rotating brush roll as illustrated by the bottom web of FIG. 1B. The brush roll was urged against the web with very light pressure sufficient to effect raising the surface fibers, yet not sufficient to damage the web to the extent that it is not useful as a tissue. It will be appreciated that the proper degree of engagement of the brush roll will depend upon many factors, including the length and stiffness of the bristles, the strength of the web, the speed differential between the web and the brush, the desired strength of the web, the desired degree of brushing, the basis weight of the web, the furnish of the web, etc. The two-ply tissue of Sample #2 was made by plying together two of such brushed webs with the brushed side of each of the two plies facing outwardly. Sample #3 was a product in accordance with this invention in which each of the two plies was brushed as described with respect to Sample #2, except the brushed sides of each ply were plied together facing inwardly as illustrated in FIG. 2B and FIG. 4. Sample #4 was a two-ply product in accordance with this invention in which only one of the two webs was brushed and the brushed side of the brushed web was plied inwardly. For each sample, the physical properties of Profile Index (PI), TMI bulk (expressed as $10^{-4}$ inch), geometric mean tensile strength (expressed as grams per 3 inches of width), and absorbency rate (expressed in seconds) were measured. The Profile Index values are those for the inwardly facing surfaces of each ply. For Sample #4, the larger Profile Index value represents the brushed surface. Absorbency rate is the time it takes for a stapled pad of twenty (2.5 inches square) sheets of tissue product (a two-ply product is one sheet) to become completely wetted out when placed on the surface of a bath of 30° C. distilled water. The results of the physical property testing are tabulated below in Table 1.

TABLE 1

| Sample | PI | TMI Bulk | Tensile Strength | Absorbency Rate |
|---|---|---|---|---|
| 1 | 2.3/2.6 | 77 | 765 | 2.91 |
| 2 | 2.3/2.0 | 82 | 729 | 3.00 |
| 3 | 7.8/7.3 | 94 | 726 | 3.34 |
| 4 | 6.6/2.6 | 88 | 710 | 3.10 |

The results illustrate unexpected increases in bulk and absorbency rate for the samples of this invention having at least one brushed web wherein the brushed side of the web is plied facing inwardly as compared to the unbrushed control and the brushed sample having the brushed sides facing outwardly.

It will be appreciated that the foregoing description, given for purposes of illustration, is not to be construed as limiting the scope of this invention, which includes all equivalents of the methods and products described herein.

We claim:

1. In a method for making a multi-ply tissue in which an aqueous slurry of papermaking fibers is continuously deposited onto a traveling foraminous fabric, dewatered, and dried to form a first tissue web, said first tissue web being combined with one or more other tissue webs to form a multi-ply tissue, the improvement comprising brushing at least one surface of the first tissue web to increase the extent to which fibers protrude from the brushed surface of the first tissue web and combining the first tissue web with the other one or more tissue webs to form a multi-ply tissue such that the brushed surface of the first tissue web is facing inwardly.

2. The method of claim 1 wherein the first web is brushed with a rotating brushing surface which rotates in the direction of travel of the web.

3. The method of claim 1 wherein the first web is brushed with a rotating brushing surface which rotates counter to the direction of travel of the web.

4. The method of claim 1 wherein the first web is brushed and thereafter creped.

5. The method of claim 1 wherein the first web is creped and brushed after creping.

6. The method of claim 1 wherein the first web is plied together with one other tissue web to form a two-ply tissue.

7. The method of claim 6 wherein both webs are brushed and plied together with their brushed sides facing inwardly.

8. The method of claim 7 wherein the two webs, prior to brushing, are the same.

9. The method of claim 7 wherein both webs are brushed with rotating brushing surfaces which rotate in the direction of travel of the respective webs.

10. The method of claim 7 wherein both webs are brushed with a rotating brushing surface which rotates counter to the direction of travel of the respective webs.

11. The method of claim 7 wherein one web is brushed with a rotating brushing surface which rotates in the direction of web travel and the other web is brushed with a rotating brushing surface which rotates counter to the direction of web travel.

12. The method of claim 1 wherein the Profile Index of the brushed surface of the first web is about 3 or greater.

13. The method of claim 1 wherein the Profile Index of the brushed surface of the first web is about 5 or greater.

14. The method of claim 1 wherein the multi-ply tissue is a two-ply tissue and wherein the inwardly facing surface of both of the tissue webs has a Profile Index of about 3 or greater.

15. A method of making a two-ply tissue comprising:

(a) continuously forming a web by depositing an aqueous slurry of papermaking fibers onto an endless foraminous fabric;

(b) dewatering and drying the web;

(c) creping the dried web;

(d) brushing a surface of the creped web with a rotating brushing surface to increase the extent to which fibers protrude from the brushed surface; and with each other.

16. The method of claim 15 wherein the web is a layered web.

17. The method of claim 16 wherein the layered web has at least one surface layer of predominantly softwood fibers.

18. The method of claim 17 wherein the predominantly softwood fiber layer constitutes the surface of the web which is brushed.

19. The method of claim 15 wherein the brushed surface of the web is the air side of the web.

20. The method of claim 19 wherein the Profile Index of the brushed surface of the web is about 3 or greater.

21. A method of making a two-ply tissue comprising:

(a) continuously forming a first web by depositing an aqueous slurry of papermaking fibers onto an endless foraminous fabric:

(b) dewatering and drying the first web;

(c) creping the first web; and (d) combining the first web with a second web, wherein prior to combining, each web is simultaneously and separately introduced into one of two separate nips formed between two backing rolls and a common rotating brush roll in which one surface of each web is brushed, the two webs being combined into a two-ply tissue with their brushed surfaces in contact with each other.

22. The method of claim 21 wherein the webs are like webs.

23. The method of claim 22 wherein the webs are layered webs.

24. The method of claim 23 wherein the brushed surface of at least one of said layered webs is a surface of a layer having predominantly softwood fibers.

25. A multi-ply tissue having two outer surfaces and two or more internal ply surfaces, wherein the Profile Index of at least one of the internal ply surfaces is greater than the Profile Index of the outer surfaces and wherein the Profile Index of at least one of said internal ply surfaces has a Profile Index of at least about 3.

26. The multi-ply tissue of claim 25 wherein the Profile Index of at least one foot he internal ply surfaces is about 5 or greater.

27. The tissue of claim 26 wherein at least two of said internal ply surfaces have a Profile Index of at least about 5.

28. The tissue of claim 27 wherein the number of plies is three.

29. The tissue of claim 27 wherein the number of plies is two.

30. A product made by the method of claim 1, 15 or 21.

* * * * *

UNITED STATES PATENT AND TRADEMARK OFFICE

CERTIFICATE OF CORRECTION

PATENT NO. : 5,180,471

DATED : January 19, 1993

INVENTOR(S) : R. D. Sauer and M. M. Jamal

It is certified that error appears in the above-identified patent and that said Letters Patent is hereby corrected as shown below:

Column 9,

In Claim 15, (d), line 3, insert after the word "and" and before the word "with":

(e) Column 10, line 3, -- Combining the brushed web with a like web to form a two ply tissue, wherein the brushed surfaces of each web are in contact.

Column 10,

In Claim 26, line 2, delete "foot he" and substitute therefor "of the."

Signed and Sealed this

Twenty-sixth Day of July, 1994

*Attest:*

*Attesting Officer*

BRUCE LEHMAN

*Commissioner of Patents and Trademarks*